US009033450B2

(12) United States Patent
Davis et al.

(10) Patent No.: US 9,033,450 B2
(45) Date of Patent: May 19, 2015

(54) PRINTER AND METHOD FOR CONTROLLING POWER CONSUMPTION THEREOF

(75) Inventors: Robert D. Davis, Brush Prairie, WA (US); Douglas Harriman, Portland, OR (US); Jon Johnson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 486 days.

(21) Appl. No.: 13/275,502

(22) Filed: Oct. 18, 2011

(65) Prior Publication Data

US 2013/0093813 A1 Apr. 18, 2013

(51) Int. Cl.
*B41J 29/393* (2006.01)
*B41J 2/045* (2006.01)

(52) U.S. Cl.
CPC ..... *B41J 2/0452* (2013.01); *B41J 29/393* (2013.01); *B41J 2/0454* (2013.01); *B41J 2/0458* (2013.01)

(58) Field of Classification Search
USPC ..... 347/17, 19, 5, 9; 400/120
IPC ..... B41J 2/0454
See application file for complete search history.

(56) References Cited

U.S. PATENT DOCUMENTS

| | | | | |
|---|---|---|---|---|
| 4,844,632 | A * | 7/1989 | Minowa | 400/120.17 |
| 5,349,905 | A | 9/1994 | Taylor et al. | |
| 6,209,984 | B1 | 4/2001 | Kim | |
| 6,568,776 | B1 | 5/2003 | Kato | |
| 6,601,941 | B1 * | 8/2003 | Jones et al. | 347/19 |
| 7,332,828 | B2 | 2/2008 | Radley | |
| 7,412,185 | B2 | 8/2008 | Hall et al. | |
| 7,461,925 | B2 | 12/2008 | Smith et al. | |
| 7,517,075 | B2 | 4/2009 | Smith et al. | |
| 7,519,837 | B2 | 4/2009 | Smith et al. | |
| 7,734,430 | B2 | 6/2010 | Smith | |
| 7,793,117 | B2 | 9/2010 | Smith | |
| 7,798,590 | B2 | 9/2010 | Snyder | |
| 2003/0076065 | A1 | 4/2003 | Shafer et al. | |

FOREIGN PATENT DOCUMENTS

| | | | |
|---|---|---|---|
| JP | 59214669 | A * | 5/1983 |
| JP | 2003231330 | | 8/2003 |
| KR | 20060110178 | | 10/2006 |

* cited by examiner

*Primary Examiner* — Lam Nguyen
(74) *Attorney, Agent, or Firm* — Dierker & Associates

(57) ABSTRACT

A printer having an internal electrical power supply is disclosed herein. A method for controlling power consumption in the printer includes receiving an image to be printed, calculating an estimated temperature of the printer, and controlling a speed of the printer to control the power consumption to keep a temperature of the printer below a predetermined maximum temperature in response to the estimated temperature.

13 Claims, 2 Drawing Sheets

PRINTER AND METHOD FOR CONTROLLING POWER CONSUMPTION THEREOF

BACKGROUND

The present disclosure relates generally to printers and methods for controlling power consumption of the printers.

Printers may use electrical energy to drive motors and actuators, heat elements, and to power computer processors and displays. Satisfaction of a printer user may be related to the amount of time to complete a print job after it has been sent from a computer. Some printers have an electrical power supply that is sized to provide power to sustain continuous printing at a maximum print speed.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
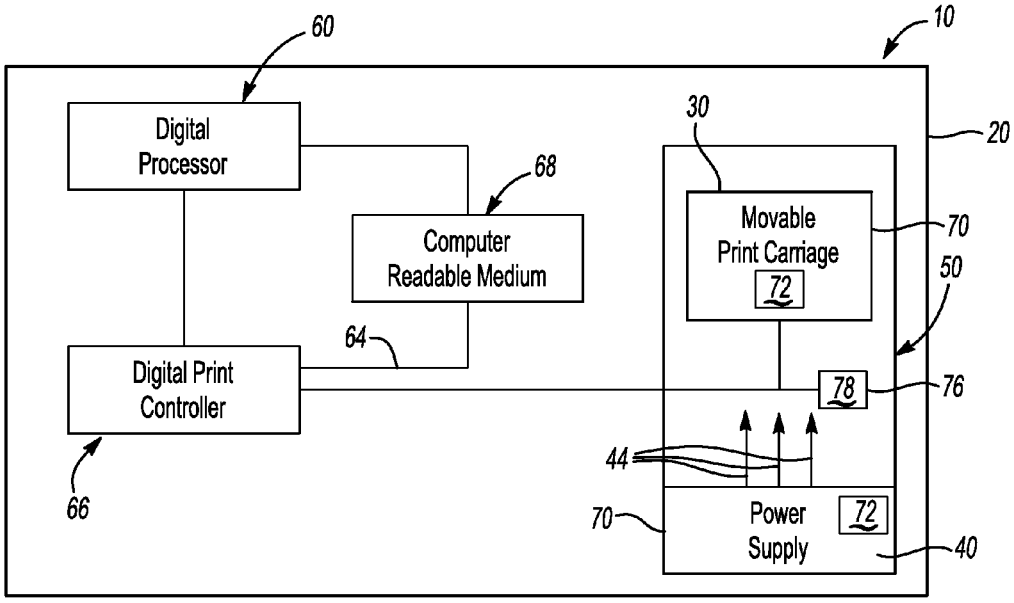
FIG. 1 is a schematic diagram of an example of a printer according to the present disclosure.

In some printers, the power supply hardware is sized to accommodate continuous printing under conditions that result in a maximum power load of the printer. In contrast, examples of the printer and method disclosed herein use active power management. Active power management allows an internal electrical power supply to be sized with minimal margin above long-term non-printing loads. A smaller sized power supply may be manufactured at a lower cost, and provide packaging flexibility to printer designers.

As used herein, a power supply is a device for converting alternating current (AC) electrical power to direct current (DC) electrical power. Power supply components may include semiconductor components and wire-wound transformers. Electrical loads connected to a power supply generally cause the components in the power supply to become warm. The components of the power supply are typically sized to match the electrical loads to prevent the temperature from exceeding limits of the components. Examples of potential consequences of exceeding certain temperature limits include a melting of insulation on wiring in a transformer or a malfunction of a power supply semi-conductor.

Power is the time rate of consumption of energy (1 Watt=1 joule per second). However, it is customary to refer to the output of an AC electrical wall outlet as electrical power interchangeably with electrical energy. As such, the use of the term power is context sensitive. It is to be understood that the terms "power" and "energy" used herein convey their ordinary contextual meanings.

Printer power supplies are typically sized to accommodate operation of the printer continuously at the printer's highest average energy consumption rate. For example, a printer's highest average energy consumption rate may correspond to printing combined text and color graphics at the printer's highest speed. It should be recognized that even though a printer may be continuously printing pages, the power load varies as a page is printed. For example, lower power loads may be experienced during paper loading and ejecting, or during delays in carriage sweeps.

Examples of the present disclosure have discovered how to successfully exploit the long thermal time constant of the power supply. A typical average power when printing in draft mode may be greater than about 10 Watts. For the same printer, the idle power may be about 2 Watts. If, for example, the printer's highest average energy consumption rate were 90 Watts, then the power supply may typically be sized for continuous duty at 90 Watts without exceeding temperature limitations.

A printer may include many electrically powered components. For example, an internal electrical power supply may provide power for integrated circuit (IC) boards, encoders, a scanner, a card reader, a wireless radio, and other board components. The board components contribute a substantially constant load for a particular printer state (i.e. SLEEP, IDLE, or PRINT). A power load associated with inkjet pens may result from warming pens and dispensing ink. Inkjet pen power loads are highly variable, depending on the frequency and types of documents printed. Power may also be consumed running a carriage motor and a paper motor as well as a scanner motor, if a scanner is included in the printer. Motor power loads in a printer are also variable, depending on the frequency and types of documents printed, and on mechanical sequences completed.

Typical power supplies may be sized to accommodate peak power loads as well as the average loads disclosed above. For example, the short term power requirements to accelerate a print mechanism and power inkjet pens on a per sweep basis may be higher than the printer's highest average energy consumption rate. Certain power supply components may be sensitive to such peak power loads and may require upsizing to accommodate the peak power loads.

Examples of the present disclosure enable the use of a lower cost power supply that meets requirements for long term power consumption while still meeting user needs for short term print performance. Print jobs are typically short in duration and spaced apart in time such that a power supply has an opportunity to cool to a lower temperature between jobs. Many printers have long periods during which the printers do not print, interrupted by brief, relatively short print jobs to print, e.g., two or three pages. As such, a typical practice of sizing the power supply for continuous use at maximum performance may add unnecessary cost and may not, in some instances, be an appreciable feature to the consumer.

Examples of the present disclosure may include an electrical power supply that is sized to reach a predetermined maximum temperature after continuous operation at a maximum speed for less than about 30 minutes; or in another example, for less than about 20 minutes. In a typical printer that is NOT an example of the present disclosure, a larger power supply would be required to avoid exceeding the rated temperatures of the power supply components to operate continuously for periods of time longer than about 30 minutes. If the power supply in the typical printer were not sized larger as stated above, the typical printer may experience thermal circuit breaker activity that cuts all power to the printer until the power supply cools.

Minimizing the time to print a small print job may be an important factor in creating a preferred consumer print experience. However, user expectations for an occasional large print job may allow for a somewhat lower print speed. For such occasional large print jobs, examples of the present disclosure provide a reasonable level of performance that does not lead to temperatures of the electrical components in the power supply exceeding their rated thresholds.

Examples of the present disclosure take into account the use models described above by meeting the power requirement for high performance, small print jobs while managing long-term power consumption. The idle time between print jobs allows the electrical components of the power supply to cool to restore the full print performance for the start of a subsequent print job.

A typical solution for controlling the temperature of a device would be to use a temperature sensor to provide feedback for control of the temperature. For example, a thermocouple could be attached to a power supply for feedback control of the output power of the power supply. A drawback to the typical solution above is that the thermocouple, connecting circuitry, and the electronic components required to convert the thermocouple signal into usable information generally add complexity and excess cost to the device.

In sharp contrast to the typical solution above, examples of the printer and method according to the present disclosure use a numerical model to estimate temperatures. The energy used to perform printer tasks is also calculated, rather than measured. Input voltage to the power supply is measured and used in the energy calculations, but the other factors in the calculations are generally preprogrammed. For example, the energy required to turn a paper transport motor to eject a page may be calculated based on preprogrammed motor specifications combined with applied motor voltage and position as a function of time. By monitoring the commands required to eject the page, the energy consumed during the ejection time can be provided to the numerical model. By similarly monitoring all of the printer commands and applying a detailed energy consumption model, an accurate estimate of energy consumption is provided to the numerical model. Since the numerical model according to examples of the present disclosure is accurate, the temperature can be controlled without actually measuring the temperature.

Further, examples of the printer and method according to the present disclosure provide adjustments to the temperature by controlling printer activities that consume energy. It is to be understood that the printer and method disclosed herein do not manage power directly. In other words, there is no particular power target or power cut-off level for average or peak rates of energy consumption. The examples of the present disclosure allow the printer to perform at a maximum speed for the most frequent print jobs and perform at satisfactory speeds for all print jobs while allowing smaller power supply components than those used by typical printers.

Figure 2:
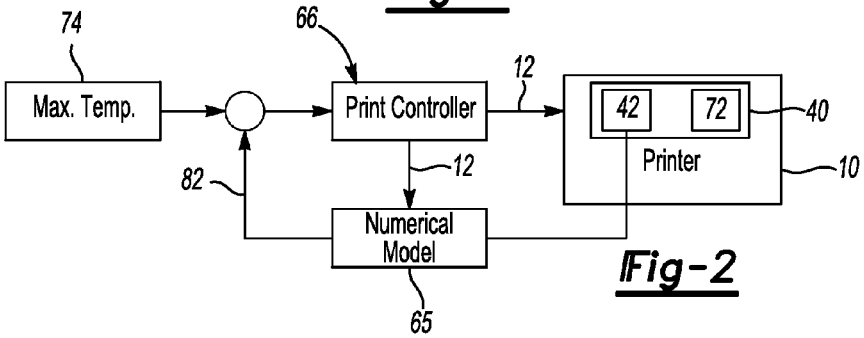
FIG. 2 is a semi-schematic control flow diagram of an example of a printer control according to the present disclosure.

Referring now to FIGS. 1 and 2, a schematic diagram of an example of a printer, and a semi-schematic control flow diagram of an example of a printer control according to the present disclosure are respectively shown. An inkjet printer 10 includes a housing 20 and a movable print carriage 30 disposed within the housing 20. An electrical power supply 40 is also disposed within the housing 20. As indicated by arrows 44, the electrical power supply 40 provides electrical power to electrically powered components 50 of the printer 10. Further, a digital processor 60 is disposed within the housing 20. The digital processor 60 calculates an estimated temperature of a thermally variant component 70 of the printer 10. It is to be understood that the thermally variant component 70 of the printer 10 may be an assembly (e.g., a power supply 40) or an individual component of an assembly. For example, a transistor (not shown) may be part of a power supply 40. The thermally variant component 70 may be a component other than the power supply 40, for example a printed circuit board (not shown) or the movable print carriage 30.

A digital printer controller 66 is disposed within the housing 20. A non-transitory, tangible computer-readable medium 68 is operatively associated with the digital printer controller 66. Instructions 64 executable by the controller 66 are embedded in the computer-readable medium 68. The instructions 64 include a subset of instructions to control a temperature 72 of the printer 10 in response to the calculated estimated temperature, by controlling a printer speed. It is to be understood that control of the temperature 72 of the printer 10 may include keeping the temperature 72 of the printer 10 below a predetermined maximum temperature 74.

The digital printer controller 66 may be any digital device that achieves the desired functionality of, at least, sending data or signals to the electrically powered components 50 and receiving data from the digital processor 60 and the computer-readable medium 68. To achieve its desired functionality, the controller 66 is operatively associated with various hardware components. These hardware components may include, for example, the processor 60, and the computer-readable medium 68. These hardware components may be interconnected through the use of a number of busses and/or network connections. For example, the digital printer controller 66 may send electronic printer operation commands 12 to the printer 10 and to the numerical model 65. The printer 10 may respond to the commands 12 by performing an action that is commanded, while the numerical model 65 may use the command to estimate the energy consumed to perform the command 12.

The processor 60 may include hardware architecture for retrieving executable code (i.e., computer-readable instructions) from the computer-readable medium 68 and for executing the executable code. The executable code may, when executed by the processor 60, cause the processor 60 to implement at least the functionality of sending data to the digital printer controller 66, and receiving data from the computer-readable medium 68. In the course of executing code, the processor 60 may receive input from and provide output to a number of other hardware components in the printer 10.

The computer-readable storage medium 68 may include various types of memory modules, including volatile and nonvolatile memory. As an example, the computer-readable storage medium 68 may include Random Access Memory (RAM), Read Only Memory (ROM), and Hard Disk Drive (HDD) memory. It is believed that other types of memory may also be used. In some instances, different types of memory in the computer-readable storage medium 68 may be used for different data storage needs. For example, the processor 60 may boot from Read Only Memory (ROM), maintain nonvolatile storage in the Hard Disk Drive (HDD) memory, and execute program code stored in Random Access Memory (RAM).

It is to be understood that the computer-readable storage medium 68 may be an electronic, magnetic, optical, electromagnetic, infrared, or semiconductor system, apparatus, or device, or any suitable combination thereof. More specific examples of the computer-readable storage medium 68 may include, for example, the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination thereof.

Referring again to FIG. 2, the printer controller 66 sends signals to the printer 10 to perform printing operations. Examples of printing operations may be the controlled movement of the print carriage 40, actuation of the pens (not shown), and the transport of media (not shown). FIG. 2 shows that information is provided from the printer controller 66 to the numerical model 65. The numerical model 65, in turn, provides temperature feedback 82 for comparing to a predetermined maximum temperature 74. For example, the predetermined maximum temperature 74 may be from about 100° C. to about 150° C. A calculated difference between the temperature feedback 82 and the predetermined maximum temperature 74 is provided to the digital printer controller 66. The digital printer controller 66 executes instructions to control the printer speed. A signal from the power supply 40 to the printer controller 66 conveys the power supply input voltage 42 to the numerical model 65. It is to be understood that an actual temperature of the power supply 40 is not measured or conveyed from the power supply 40 to the numerical model 65 in examples of the present disclosure.

Figure 3:
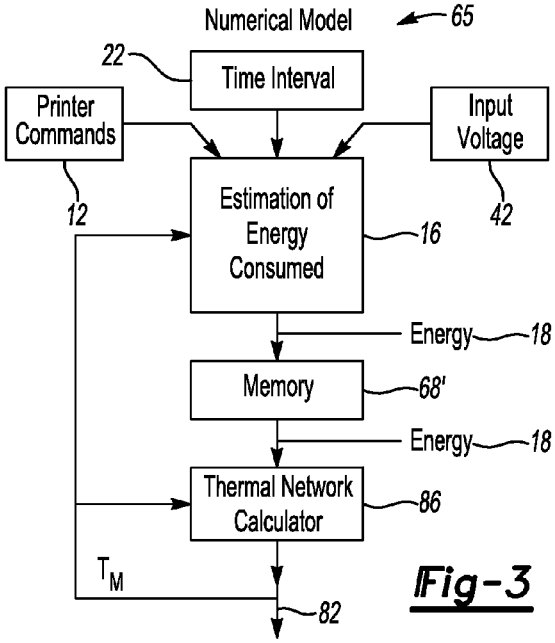
FIG. 3 is a block diagram of an example of a numerical model according to the present disclosure.

FIG. 3 is a block diagram of an example of a numerical model 65 according to the present disclosure. The numerical model 65 may repeatedly perform the calculations of the numerical model 65 at regular intervals spaced by a predetermined time interval 22. As an example, the predetermined time interval 22 may be about 5 seconds. As such, the numerical model 65 in the example would perform calculations on a cycle of about 5 seconds. The numerical model 65 may include an estimation 16 of a quantity of energy consumed to perform printer operations over the predetermined time interval 22. The power supply input voltage 42 and the printer commands 12 (e.g., the speeds of the motors) may be inputs to the estimation 16 of energy consumed. The estimate of the quantity of energy consumed 18 may be entered into a memory 68'. The estimate of the quantity of energy 18 is accessed from the memory 68' and is used as a factor by a thermal network calculator 86.

The thermal network calculator 86 provides the feedback temperature 82 for comparing to the predetermined maximum temperature 74 as shown in FIG. 2. The feedback temperature 82 may be a subset of a plurality of heat-generating component temperatures $T_M$ output by the thermal network calculator 86. The plurality of heat-generating component temperatures $T_M$ may be conveyed as an input to the thermal network calculator 86 and for the estimation 16 of energy consumed to be used in subsequent calculations. For example, a temperature of a component may be calculated incrementally from a previous temperature of the component. Further, the energy consumed by a motor may depend on a temperature of the motor.

It is to be understood that the estimation 16 of the quantity of energy consumed may include estimations of quantities of energy consumed by a plurality of separate, heat-generating components 76 (see FIG. 1) included in the calculation by the thermal network calculator 86. Examples of the plurality of separate, heat-generating components 76 include an electric motor, an inkjet pen, an electronic circuit board, the electrical power supply 40, or combinations thereof (components not shown individually). The thermal network calculator 86 may also yield a respective plurality of estimated heat-generating component temperatures $T_M$. As such, $T_M$ indicated in FIG. 3 may represent a scalar number, or it may represent a numerical array including a plurality of estimated heat-generating component temperatures 78 (see FIG. 1) as elements of the array.

The calculation by the thermal network calculator 86 may be relatively complex to accurately model a thermal behavior of an internal electrical power supply 40 compared to an external power supply (not shown). An external power supply would be, for example, a power supply that is located at an AC wall outlet or at some location along a power cord generally external to the printer 10. For the external power supply, most of the heat transfer occurs between the external power supply and the surrounding air/ambient environment. For an internal power supply 40, heat may be transferred between any nearby components of the printer 10. As such, a thermal network to be calculated by the thermal network calculator 86 would tend to grow in complexity as the number of nearby components increases.

Figure 4:
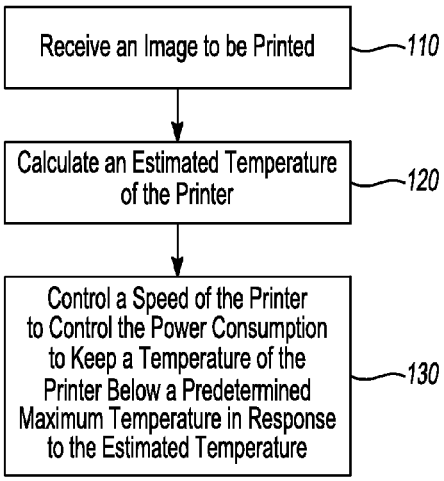
FIG. 4 is a flowchart depicting an example of the method according to the present disclosure.

FIG. 4 is a flowchart depicting an example of the method according to the present disclosure for controlling power consumption in a printer 10 having an internal electrical power supply 40. The method includes an instruction to receive an image to be printed, as shown at block 110. The image may be from a computer, scanner, memory, hard drive or any other source. The method further includes calculating an estimated temperature of the printer, as shown at block 120. For example, an estimate of the temperature of the printer, more specifically a temperature of an internal electrical power supply 40, may be calculated. Examples of the method may use a control loop that includes temperature feedback 82 calculated in the numerical model (see FIG. 2). The method further includes controlling a speed of the printer 10 to control the power consumption to keep a temperature 72 of the printer 10 below a predetermined maximum temperature 74 in response to the estimated temperature, as shown at block 130.

The speed of the printer 10 may be any speed associated with the printer 10. For example, the speed of the printer 10 may be a speed of a print carriage motor, a speed of a paper transport motor, or a speed of a scanner motor. It is to be understood that by reducing the speed of the print carriage motor, the rate of energy consumption of inkjet pens mounted on the print carriage may be consequentially reduced. Controlling the speed of the printer 10 may include limiting a maximum speed of the printer 10 for a predetermined time period. For example, the maximum speed of the print carriage motor may be limited for about 5 minutes. In an example, the speed limit is valid until the next speed limit is calculated (which calculation occurs after the predetermined time interval 22, as described above).

Figure 5:
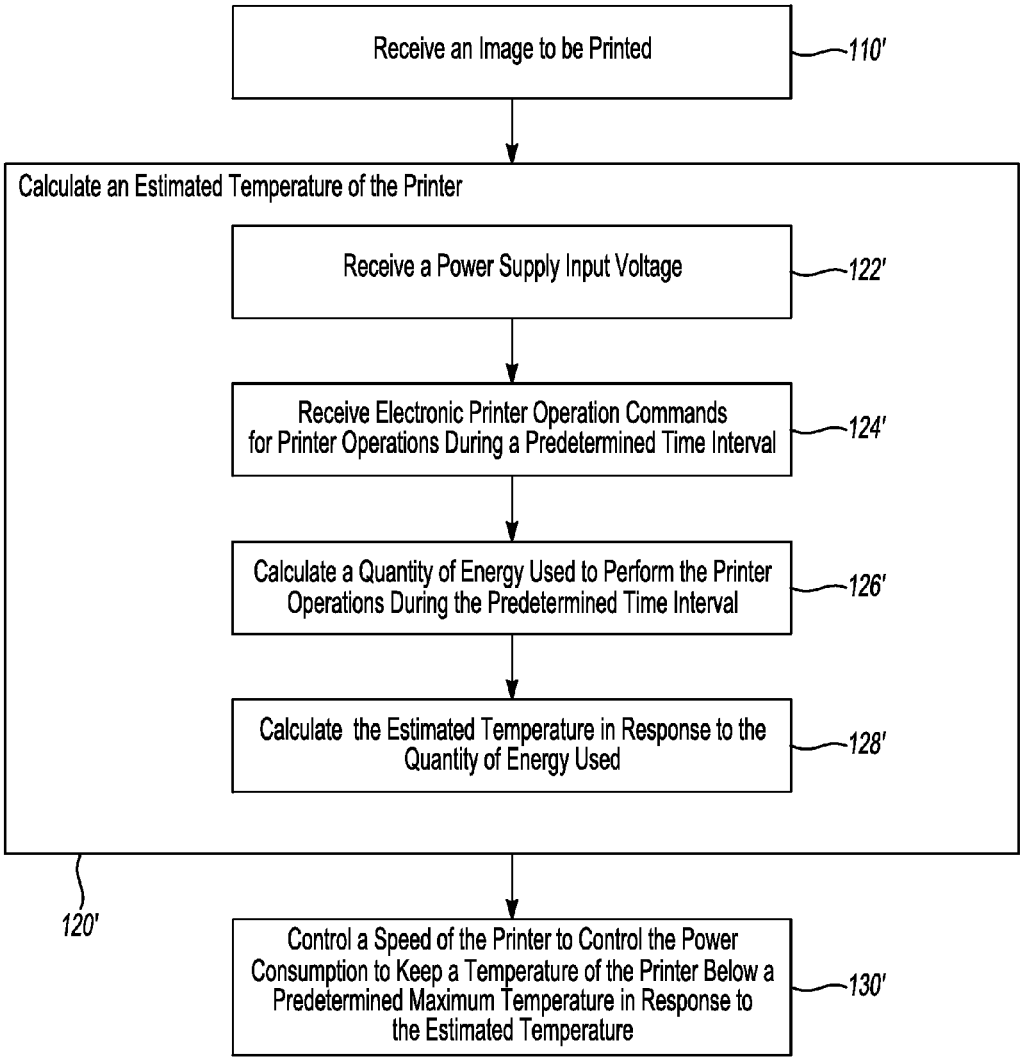
FIG. 5 is a flowchart of another example of the method according to the present disclosure.

FIG. 5 is a flowchart depicting another example of the method for controlling power consumption in a printer 10 having an internal electrical power supply 40 according to the present disclosure. The example shown in FIG. 5 is similar to the example shown in FIG. 4 except the block at 120' includes additional steps. An instruction to receive an image to be printed is shown at block 110'. Calculating an estimated temperature of the printer is shown at block 120'. Calculating the estimated temperature of the printer includes receiving a power supply input voltage 42, as shown at block 122'. Receiving electronic printer operation commands 12 for printer operations during a predetermined time interval is shown at block 124'. Examples of printer operation commands include a command to feed paper through the printer 10 and to dispense drops of ink through an inkjet pen. Calculating a quantity of energy used to perform the printer operations during the predetermined time interval 22 is shown at block 126'. For example, the amount of energy required to dispense a drop of ink may be known. By counting the ink drops commanded, the amount of energy used by the inkjet pens to dispense the ink may be calculated. Calculating the estimated temperature in response to the quantity of energy used is shown at block 128'. Similarly to the example depicted in FIG. 4, at block 130' is shown controlling a speed of the printer 10 to control the power consumption to keep a temperature 72 of the printer 10 below a predetermined maximum temperature 74 in response to the estimated temperature.

Even though the temperature 72 of the printer 10 is not directly in the feedback control loop, it is to be understood that the feedback temperature 82 is believed to be an accurate calculated estimate of the temperature 72 of the printer 10. As such, examples of the printer and method of the present disclosure indirectly control the temperature 72 to be below the predetermined maximum temperature 74.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Further, it is to be understood use of the words "a" and "an" and other singular referents include plural as well, both in the specification and claims.

Yet further, it is to be understood that the ranges provided herein include the stated range and any value or sub-range within the stated range. For example, power ranging from about 10 Watts to about 20 Watts should be interpreted to include not only the explicitly recited amount limits of about 10 W to about 20 W, but also to include individual amounts, such as 10 W, 13.5 W, 15 W, 18 W, etc., and subranges, such as 10 W to 12 W, etc. Furthermore, when "about" is utilized to describe a value, this is meant to encompass minor variations (up to +/−5%) from the stated value except where specifically stated otherwise in this document.

While several examples have been described in detail, it will be apparent to those skilled in the art that the disclosed examples may be modified. Therefore, the foregoing description is to be considered non-limiting.

What is claimed is:

1. An inkjet printer, comprising:

a housing;

a movable print carriage disposed within the housing;

an electrical power supply disposed within the housing and providing electrical power to electrically powered components of the printer;

a digital processor disposed within the housing, the processor to calculate an estimated temperature of a thermally variant component of the printer; and a digital printer controller disposed within the housing and having operatively associated therewith a non-transitory, tangible computer-readable medium having embedded therein instructions executable by the controller, the instructions interdependently to control:

a printer speed;

a power consumption of the printer; and a temperature of the printer in response to the calculated estimated temperature;

wherein the computer-readable medium further includes instructions to apply a numerical model to determine the calculated estimated temperature;

the numerical model includes an estimation and entry into a memory of an estimate of a quantity of energy used to perform printer operations over a predetermined time interval, and a thermal network calculation including the estimate of the quantity of energy used as a factor; and the estimation of the quantity of energy used includes estimations of quantities of energy consumed by a plurality of separate, heat-generating components operatively disposed within the housing and included in the thermal network calculation, the thermal network calculation yielding a plurality of respective estimated heat-generating component temperatures.

2. The printer as defined in claim 1, wherein the thermally variant component is the electrical power supply, an electric motor operatively disposed within the housing, or both the electrical power supply and the electric motor.

3. The printer as defined in claim 1 wherein the computer-readable medium further includes instructions to keep the temperature of the printer below a predetermined maximum temperature.

4. The printer as defined in claim 3 wherein the thermally variant component is the electrical power supply.

5. The printer as defined in claim 4 wherein the electrical power supply is sized to reach the predetermined maximum temperature after continuous operation at a maximum speed for less than about 30 minutes.

6. The printer as defined in claim 1 wherein the printer speed is a speed of a carriage motor operatively connected to the print carriage.

7. The printer as defined in claim 1 wherein the plurality of separate, heat-generating components include an electric motor, an inkjet pen, an electronic circuit board, the electrical power supply, or combinations thereof.

8. A non-transitory, tangible computer-readable medium having embedded therein instructions executable by a processor for controlling power consumption in a printer having an internal electrical power supply, the instructions to:

receive an image to be printed;

calculate an estimated temperature of the printer;

control a speed of the printer to control the power consumption to keep a temperature of the printer below a predetermined maximum temperature in response to the estimated temperature; and apply a numerical model to calculate the estimated temperature;

the numerical model includes an estimation and entry into a memory of an estimate of a quantity of energy used to perform printer operations over a predetermined time interval, and a thermal network calculation including the estimate of the quantity of energy used as a factor; and the estimation of the quantity of energy used includes estimations of quantities of energy consumed by a plurality of separate, heat-generating components operatively disposed within the printer and included in the thermal network calculation, the thermal network calculation yielding a plurality of respective estimated heat-generating component temperatures.

9. The computer-readable medium as defined in claim 8, wherein the temperature of the printer is a temperature of the internal electrical power supply.

10. The computer-readable medium as defined in claim 8 wherein the speed of the printer is chosen from a speed of a print carriage motor, a speed of a paper transport motor, and a speed of a scanner motor.

11. The computer-readable medium as defined in claim 8 wherein the speed of the printer is a speed of a print carriage motor.

12. The computer-readable medium as defined in claim 8 wherein a control loop includes a temperature feedback calculated in the numerical model.

13. The computer-readable medium as defined in claim 8 wherein the plurality of separate, heat-generating components include an electric motor, an inkjet pen, an electronic circuit board, the electrical power supply, or combinations thereof.

* * * * *